US007779565B2

(12) United States Patent
Jiang et al.

(10) Patent No.: US 7,779,565 B2
(45) Date of Patent: Aug. 24, 2010

(54) IRONING APPLIANCE COMPRISING IDENTIFICATION MEANS FOR IDENTIFYING THE FABRIC TYPE OF ARTICLES TO BE IRONED

(75) Inventors: Yong Jiang, Singapore (SG); Tang Pong Har, Singapore (SG); Mun Thoh Ma, Singapore (SG); Mong Hua Tan, Singapore (SG); Mohankumar Valiyambath Krishnan, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 288 days.

(21) Appl. No.: 11/910,488

(22) PCT Filed: Apr. 3, 2006

(86) PCT No.: PCT/IB2006/051007

§ 371 (c)(1),
(2), (4) Date: Oct. 2, 2007

(87) PCT Pub. No.: WO2006/106472

PCT Pub. Date: Oct. 12, 2006

(65) Prior Publication Data

US 2009/0265964 A1 Oct. 29, 2009

(30) Foreign Application Priority Data

Apr. 7, 2005 (EP) ..... 05102737

(51) Int. Cl.
*D06F 81/00* (2006.01)
*D06F 75/00* (2006.01)

(52) U.S. Cl. ..... 38/103; 38/137

(58) Field of Classification Search ..... 38/2, 38/103, 104, 137, 144, 14, 15, 16, 1 C, 1 D, 38/77.7, 138–140; 219/248, 250; 340/572.1
See application file for complete search history.

(56) References Cited

U.S. PATENT DOCUMENTS 2,313,918 A * 3/1943 Brownlee ..... 38/40
2,395,787 A * 2/1946 Ledbetter et al. ..... 38/40
5,315,773 A * 5/1994 Iwami et al. ..... 38/77.6
5,391,859 A * 2/1995 Hazan et al. ..... 219/250

(Continued)

FOREIGN PATENT DOCUMENTS

DE 202004007685 9/2005

(Continued)

*Primary Examiner*—Ismael Izaguirre

(57) ABSTRACT

An ironing appliance (1) comprises an ironing device such as a steam iron and an ironing board (11) for supporting articles (2) to be ironed. In the ironing board (11), Radio Frequency Identification readers (41) are arranged, which serve for identifying the fabric type of the articles (2) to be ironed, which are provided with a tag (45) containing this information. The ironing board (11) has a heater (16) for heating the articles to be ironed, and is also adapted to supplying steam to these articles. In an ironing process of a given article, the characteristics of the supply of steam and the temperature of the heater (16) are determined on the basis of the information obtained from the tag (45) of the article by the readers (41). Due to the fact that the readers (41) are arranged in the ironing board (11), the identification process and the process of determining appropriate ironing settings take place in a fast and accurate manner.

21 Claims, 4 Drawing Sheets

Figure 1:
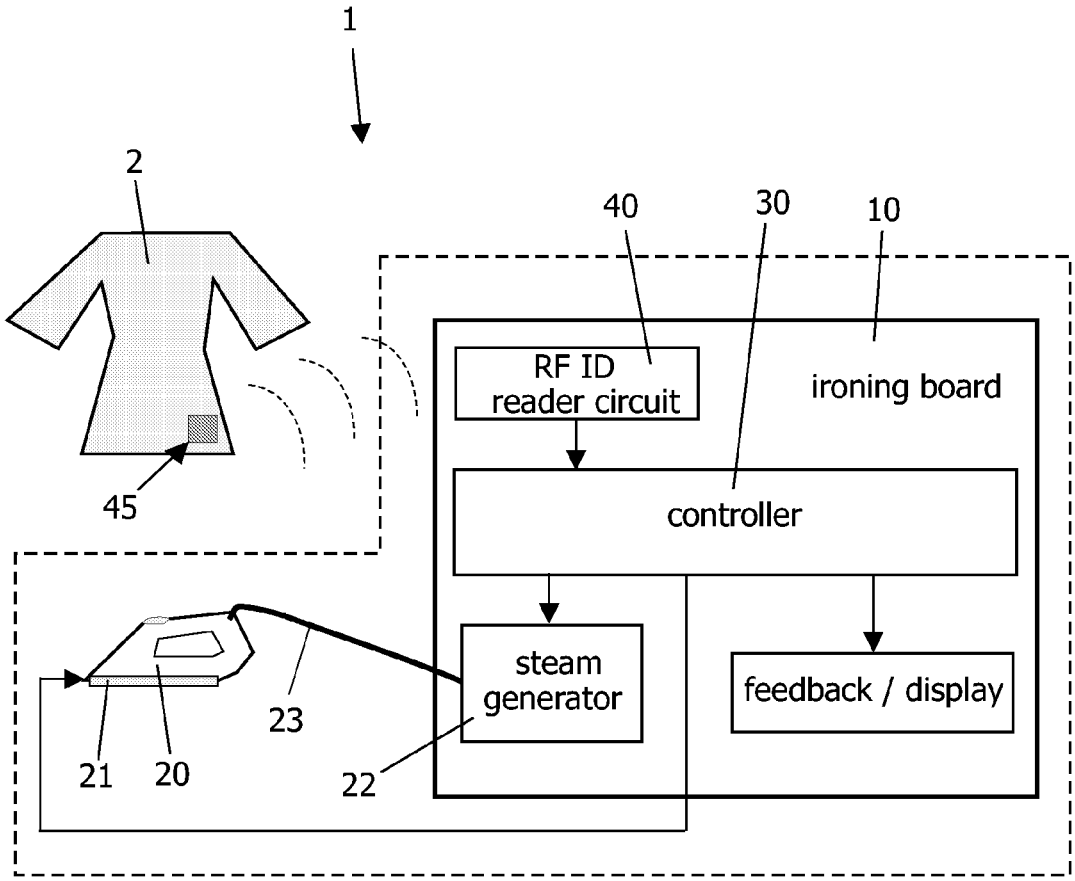

U.S. PATENT DOCUMENTS 5,642,578 A * 7/1997 Hazan et al. ..... 38/77.7
5,642,579 A * 7/1997 Netten et al. ..... 38/77.7

FOREIGN PATENT DOCUMENTS

| | | |
|---|---|---|
| EP | 0587472 | 3/1994 |
| JP | 05269299 | 10/1993 |
| WO | 0131112 | 5/2001 |
| WO | 0196645 | 12/2001 |
| WO | 2004055256 | 7/2004 |

* cited by examiner

IRONING APPLIANCE COMPRISING IDENTIFICATION MEANS FOR IDENTIFYING THE FABRIC TYPE OF ARTICLES TO BE IRONED

The present invention relates to an ironing appliance, comprising: an ironing device for ironing articles; an ironing board for supporting the articles; and identification means for identifying at least one characteristic of the articles to be ironed.

Ironing appliances comprising an ironing device and an ironing board are generally known. In many cases, the ironing device comprises a steam iron having a heatable soleplate and steam holes arranged in the soleplate for the purpose of letting through steam to the articles to be ironed. The steam is generated with the help of a steam generator, which may be accommodated by the steam iron, or which may be arranged outside of the steam iron, for example in the ironing board, or in a separate stand.

The ironing board serves for supporting the articles to be ironed. In the following, for the sake of simplicity, a portion of the ironing board which is intended for actually contacting and supporting the articles will be referred to as supporting portion.

When a user wants to subject an article to an ironing process, he/she positions the article on the ironing board, and moves the steam iron over the article in order to heat the article and/or to supply steam to the article. Under the influence of the heat and/or the steam, wrinkles are removed from the article. In the process, among other things, it is important that the temperature of the soleplate is adapted to the fabric type of the article. On the one hand, in order to avoid scorching of the article, the temperature of the soleplate may not be too high. On the other hand, in order for the ironing process to be effective, the temperature of the soleplate may not be too low. Therefore, while applying a usual ironing appliance, the user needs to control the temperature of the soleplate in a rather accurate manner, wherein it is necessary for the user to recognize the fabric type of the articles to be ironed, and to have knowledge of the associated required temperature of the soleplate.

In WO 01/96645, a system for ironing clothes is described, which comprises an iron; a director in communication with the iron; a data store in communication with the director; an identification device in communication with the director; a clothing identifier; and an optimization module in communication with the director. The optimization module comprises executable instructions for determining optimized operating conditions of the iron. Furthermore, a method of ironing of clothing is described, comprising the steps of: placing a garment on an ironing board; identifying the item to be ironed; entering current garment conditions; inputting desired conditioning of the garment; transmitting one or more conditioning options corresponding to the item of clothing to the director; and determining optimal ironing conditions corresponding to the ironing factors of the item of clothing.

For the purpose of identifying the item to be ironed, an identification device comprising a radio frequency scanning device may be applied. Radio Frequency Identification, which will hereinafter be abbreviated to RF ID, uses radio frequency communication to automatically identify, track and manage objects. A low-frequency, passive, magnetically-coupled RF ID system comprises two parts: a reader and a tag. The tag is a small sophisticated radio transmitter and receiver, which is powered by a radio frequency field generated by the reader. Typically, the tag is attached to the item to be ironed, while the reader is arranged such as to be in communication with the director. When the user puts a garment provided with a tag in the vicinity of the reader, information is derived from the tag. Subsequently, this information is used as input in a process of determining optimal settings of the iron.

It is an objective of the present invention to provide an ironing appliance having an ironing device such as a steam iron, an ironing board, and identification means for identifying at least one characteristic of articles to be ironed, which is easy to use, and which is capable of identifying the articles and realizing appropriate ironing conditions in a fast and accurate manner. This objective is achieved by an ironing device in which the identification means are arranged in the ironing board.

According to the present invention, the identification means for identifying at least one characteristic of articles to be ironed are arranged in the ironing board. As an advantageous consequence, the process of identifying an article to be ironed may take place as soon as the article is placed on the ironing board. In this way, information associated with the article is obtained at an early stage, namely before a user picks up the ironing device and moves it toward the article, so that there is sufficient time for determining and setting various ironing parameters of the ironing appliance. There would be less time for doing so in case the identification means would be arranged in the ironing device, as in such a case, the user needs to pick up the ironing device and bring it in the vicinity of the article first, before the identification means are capable of identifying the article. In case the identification means would be arranged separately from the ironing board, it would be necessary for the user to bring the article to be ironed in the vicinity of the place where the identification means are, prior to placing the article in the ironing board. Hence, in such a case, it would be necessary for the user to perform an extra action, which is undesirable.

In a preferred embodiment of the present invention, the ironing appliance comprises a steam generator, wherein a supporting portion of the ironing board is permeable to steam, and wherein conveying means are provided for conveying steam from the steam generator to the supporting portion of the ironing board during operation of the ironing appliance. In such an embodiment, during operation, steam is supplied to the articles to be ironed by the ironing board. Given the fact that an ironing board capable of supplying steam to the articles to be ironed plays an active role in the ironing process, such an ironing board is also referred to as active ironing board. An advantage of the application of an active ironing board is that it is possible to obtain a relatively high steaming rate, and thereby meet the demands of the current market.

Preferably, the conveying means for conveying steam from the steam generator to the supporting portion of the ironing board during operation of the ironing appliance comprise at least two separate units. In that case, it is possible to use the identification means for detecting which units are covered by an article to be ironed, and which units are left uncovered. Unnecessary loss of steam can be avoided by only providing the covered units with steam.

When an ironing board capable of supplying steam to the articles to be ironed is applied, it is advantageous to have means for controlling a temperature of the steam that is supplied to the supporting portion of the ironing board during operation of the ironing appliance. With the help of such means, it is possible to use the supply of steam for both moistening the articles to be ironed and heating these articles. Consequently, it is possible to use the ironing device only as a stretching device for flattening the articles, wherein the temperature of the ironing device can be relatively low. In this way, the risk of the articles getting scorched by the ironing device is considerably reduced.

According to a preferred option, the ironing appliance is equipped with means for heating a supporting portion of the ironing board. When such means are applied, it is achieved that an ironing process of an article takes place under the influence of heat supplied by both the ironing board and the ironing device, as a result of which the effectiveness of the ironing process is enhanced. Advantageously, the heating means are mounted in the ironing board. The heating means may comprise a tubular heater or a flat resistive tracks heater, for example.

According to another preferred option, the ironing appliance is equipped with means for displacing air, which are arranged in the ironing board, wherein a supporting portion of the ironing board is permeable to air.

In a possible embodiment, the means for displacing air may comprise a vacuum pump, wherein apertures are formed in the supporting portion of the ironing board. When an article is placed on the supporting portion of the ironing board, and the vacuum pump is operated, the article is urged against an upper surface of the supporting portion. In this way, it is ensured that the article remains in position during the ironing process.

In another possible embodiment, use is made of a ventilator in stead of a vacuum pump, which ventilator may serve as a blowing means or as a vacuum means. In the first case, the ventilator may be used to blow air toward an article that is placed on the supporting portion of the ironing board, through the apertures in the supporting portion, in order to inflate the article and avoid incorrect creases.

Preferably, in case a ventilator is used as a blowing means or as a vacuum means, one of the following two types of ventilator is arranged in the ironing appliance. A first type of ventilator is a ventilator having two fans arranged in series, wherein one fan is designed for blowing by rotating in a first direction, and wherein another fan is designed for creating suction by rotating in a second direction which is opposite to the first direction. Advantageously, separate motors are arranged for driving the fans. A second type of ventilator is a ventilator having a single bidirectional rotating fan. Dependent of the direction of rotation of the fan of such a ventilator, a blowing action or a sucking action is obtained.

In case conveying means are provided for conveying steam from a steam generator to the supporting portion of the ironing board, it is a feasible possibility to apply the same conveying means for the purpose of conveying air that is forced to flow toward the apertures in the supporting portion or that is sucked in through these apertures.

Advantageously, for the purpose of determining optimal ironing conditions and controlling the operation of the ironing device, and, in case an active ironing board is applied, the ironing board, the ironing appliance comprises controller means which are connected to the identification means, and which are adapted to using input provided by the identification means in a process of determining control parameters. In a practical embodiment, a database containing predetermined combinations of input provided by the identification means and settings of one or more components of the ironing appliance may be provided, which is suitable to be used in the process of determining control parameters.

The controller means may be programmed such as to stop a process of heating the ironing device, or to let this process take place at a reduced level, in case it appears that a current temperature setting of the ironing device is too high in relation to the fabric of the article as identified by the identification means. Moreover, it is possible that the ironing board is provided with a ventilator or the like for the purpose of actively cooling down the ironing device, wherein the controller means are programmed such as to activate the ventilator in case it appears to be necessary to make sure that the temperature of the ironing device quickly drops to a lower level. In the process, the ventilator may be operated such as to blow air in the direction of the ironing device, which does not alter the fact that it is also possible to operate the ventilator such as to suck in air for the purpose of cooling down the ironing device. In either case, an air flow for abstracting heat from the ironing device is created. An example of a situation in which it is required to realize a substantial temperature drop of the ironing device is a situation in which a garment made of polyester or another synthetic fibre will be ironed right after a garment made of cotton or another natural fibre has been ironed.

The identification means may function in any suitable manner. Nevertheless, it is preferred if these means comprise a reader which is capable of generating a radio frequency field for powering tags including an electronic circuit and a tuned antenna-capacitor circuit, in other words, which is part of an RF ID system. In such a case, the articles to be ironed should be provided with the tags, which is a feasible option, given the fact that the tags do not need to be larger than labels which are commonly used in clothing. Since there is no physical contact or viewing required, the RF ID system allows for a great freedom of movement.

The present invention also relates to an ironing board, suitable for use in an ironing appliance, and a method for controlling an ironing appliance.

Furthermore, the present invention relates to an ironing board for supporting articles to be ironed, which does not necessarily need to be part of the ironing appliance having identification means as described in the foregoing.

The present invention also relates to an ironing board for supporting articles to be ironed, comprising a compartment for containing an agent such as an agent for treating the articles to be ironed or an agent for supplying a fragrance to the articles to be ironed and/or a vicinity of the ironing board.

Many people regard performing an ironing process as a boring and tiring process. A known possibility of making the ironing process more interesting is introducing a pleasant smell during this process. According to the state of the art, irons equipped with a fragrance delivery system are provided. During operation, such irons are capable of supplying a fragrance to a vicinity of the ironing board. In this way, a user of the iron may be subjected to aroma therapy, which has a relaxing effect on the user. Also, the irons having a fragrance delivery system may be used for the purpose of supplying a fragrance to the articles to be ironed, so that these articles are provided with a fresh smell.

In a steam iron having a fragrance delivery system, this system may be realized as a separate additive delivery system, but it may also be part of the steam delivery system. However, especially in the latter case, a supply of fragrance water may cause an undesired phenomenon known as "spitting" during the ironing process, wherein water droplets are released by the iron, and wherein scale particles are carried along with the droplets. There is a considerable chance that an article that is treated by means of the steam iron gets stained by the droplets and the scale particles. Therefore, there is a need for a method of fragrance delivery which does not have the side-effect of deteriorating any ironing performance results.

According to the present invention, the ironing board is used to supply a fragrance or other additives. In particular, according to the present invention, an ironing board is provided, comprising a compartment for containing an agent such as an agent for treating the articles to be ironed or an agent for supplying a fragrance to the articles to be ironed and/or a vicinity of the ironing board, wherein the compartment has at least one opening for releasing the agent.

In comparison with a hand-held steam iron, an ironing board offers more space for the components needed for a supply of a fragrance or other additives. Hence, there is more freedom in respect of the design of a delivery system. Furthermore, in the ironing board, there is no need to combine the function of supplying a fragrance or other additives with the function of supplying steam, so that it is ensured that the supply of a fragrance or other additives does not deteriorate the ironing performance results.

The compartment may be suitable for containing any type of fragrance additive or another additive, in any form, from solid to liquid, or as a gel. The compartment may even be applied for receiving and containing materials such as flowers.

Well-known examples of other possible additives are a wrinkle reducing additive and a wrinkle resistant additive. For examples of such additives, reference is made to applicant's former applications EP 03792552.6 (filing date 5 Aug. 2003) and WO 01/31112 (filing date 27 Oct. 2000). Both EP 03792552.6 and WO 01/31112 are hereby incorporated by reference.

Preferably, the ironing board according to the present invention comprises means for forcing agent to flow out of the ironing board. For example, in case the compartment encloses a solid fragrance block, and the ironing board comprises a fan, the fan is used to direct the fragrance emitted by the fragrance block to the desired location, which may for example be a location on the ironing board where an article to be ironed is present.

In a preferred embodiment, the compartment is removably arranged with respect to other components of the ironing board, so that it is easy for a user to place the fragrance agent in the compartment.

In case the compartment for containing an agent is arranged in an ironing board having identification means for identifying at least one characteristic of the articles to be ironed and controller means for controlling the operation of the ironing appliance on the basis of input provided by the identification means, it is possible to control the delivery of the agent to the articles to be ironed and/or the vicinity of the ironing board on the basis of at least one detected characteristic of the articles. For example, in case the compartment is filled with a wrinkle resistant additive, and an article to be ironed appears to be a business shirt, the controller means control the quantity of released agent to be higher than in case an article to be ironed appears to be a casual shirt, for example.

Figure 2:
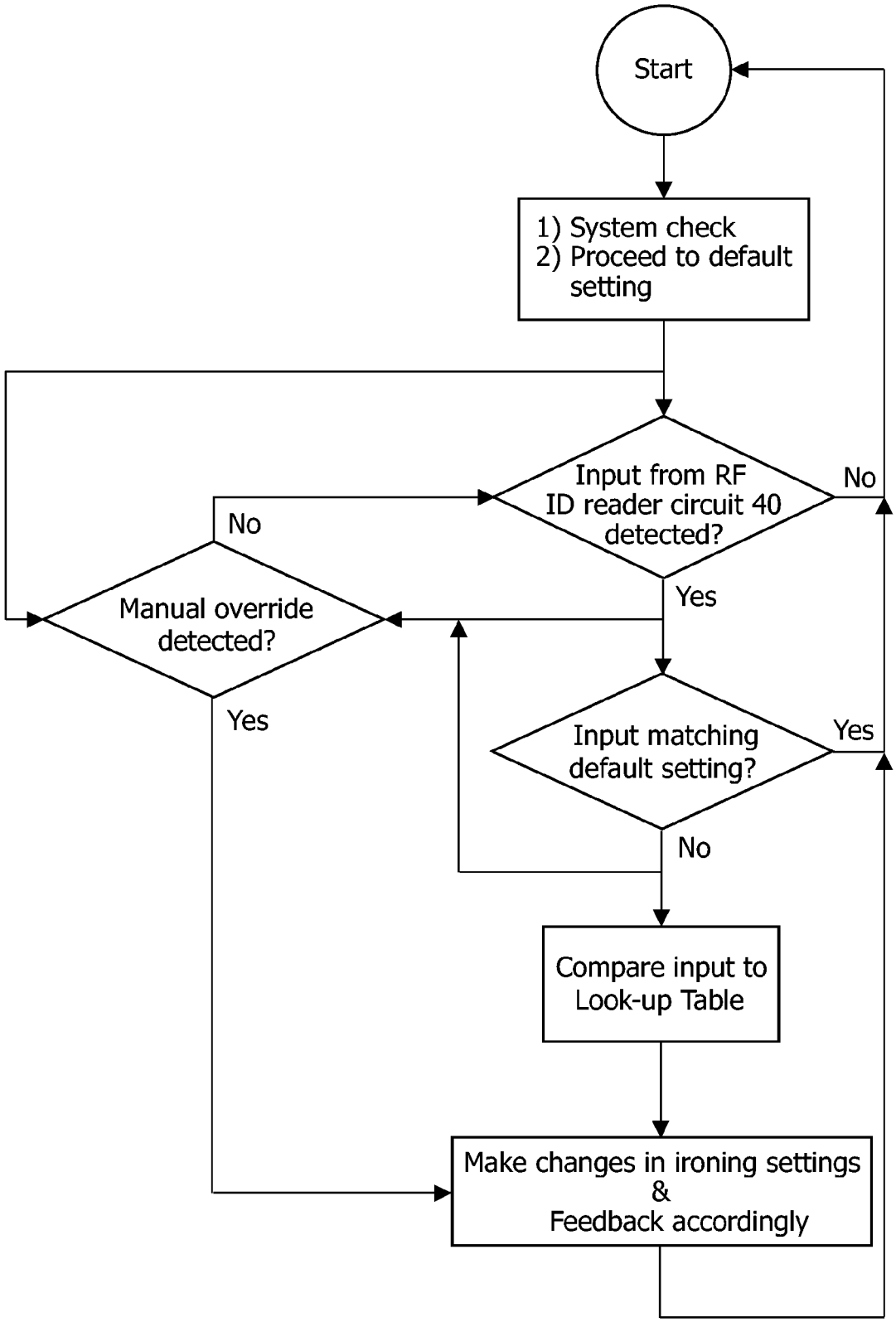
Figure 3:
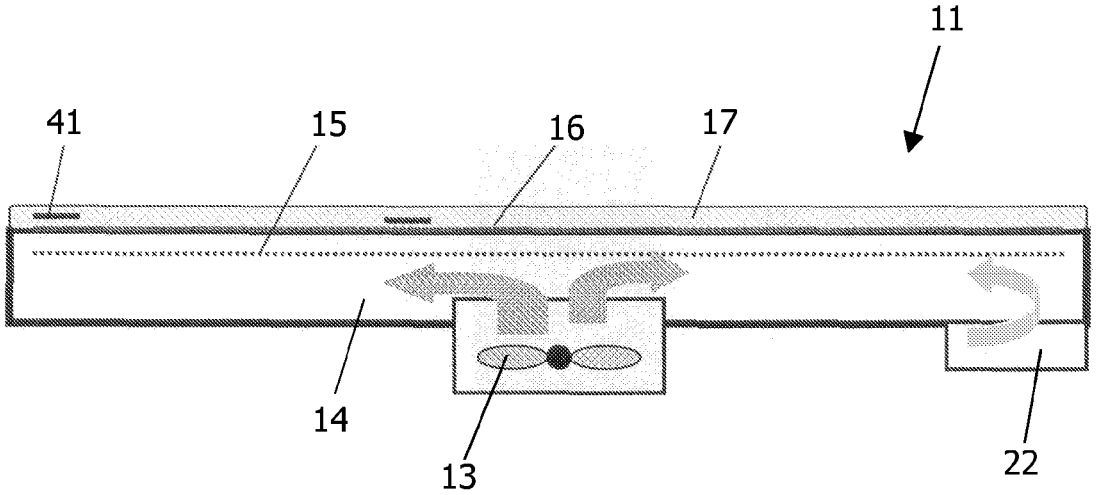
Figure 4:
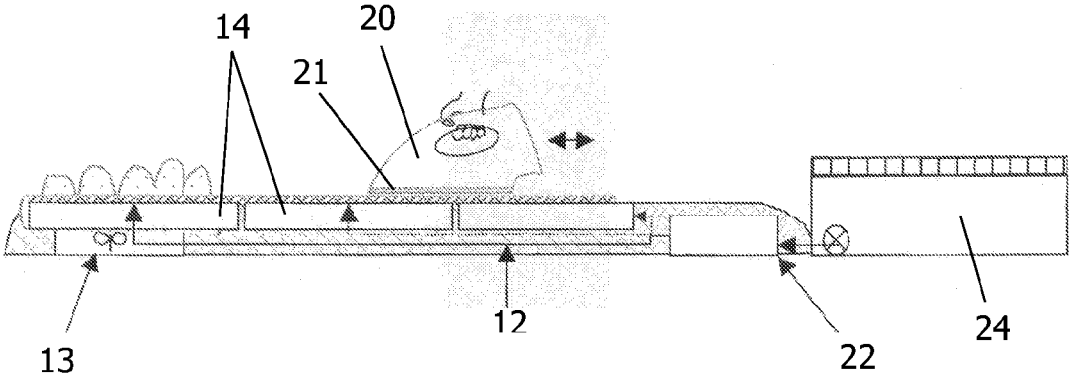
Figure 5:
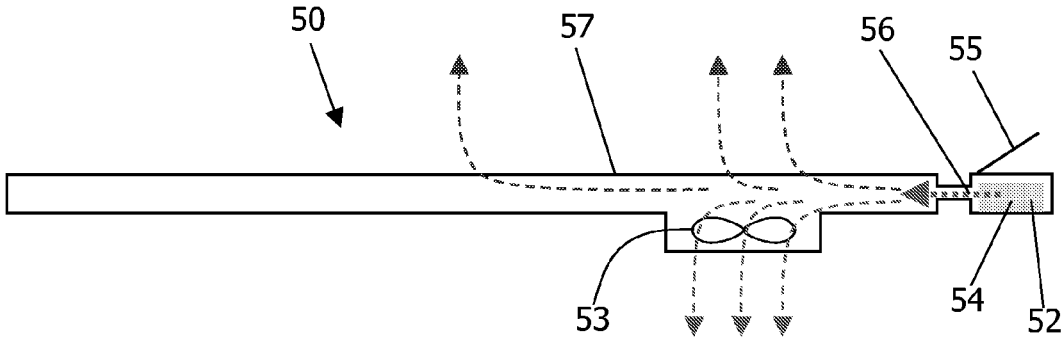
Figure 6:
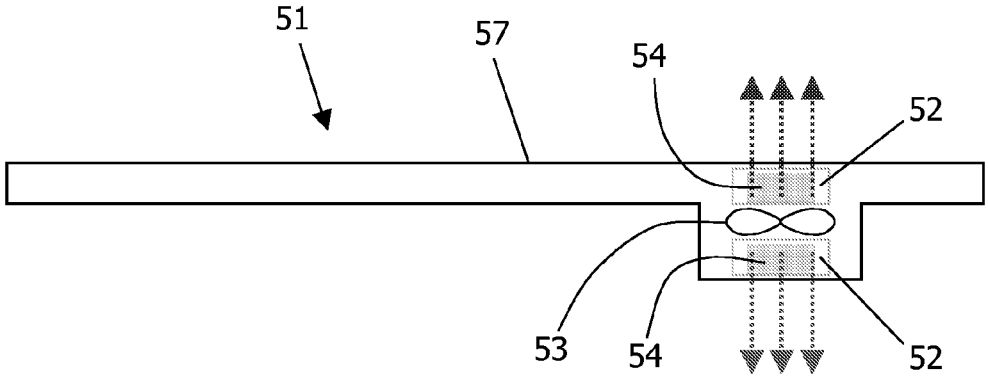
Figure 7:
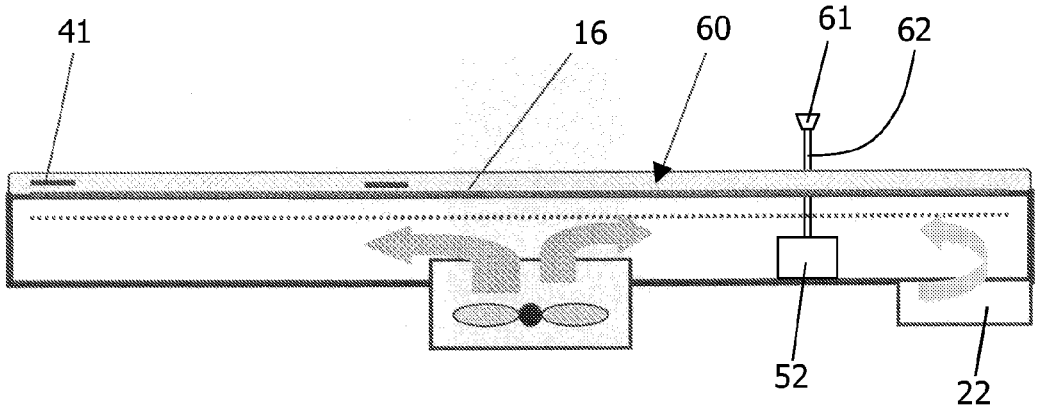

The present invention will now be explained in greater detail with reference to the Figures, in which similar parts are indicated by the same reference signs, and in which:

FIG. 1 diagrammatically shows an ironing appliance according to the present invention and an article to be ironed;

FIG. 2 is a flowchart showing a series of steps which are followed when the ironing appliance is operated;

FIG. 3 diagrammatically shows a first preferred embodiment of an ironing board having identification means for identifying at least one characteristic of articles to be ironed;

FIG. 4 diagrammatically shows a second preferred embodiment of an ironing board as shown in FIG. 3 and an ironing device;

FIG. 5 diagrammatically shows a first preferred embodiment of an ironing board having a fragrance compartment and a fan for generating an air flow of fragrance;

FIG. 6 diagrammatically shows a second preferred embodiment of an ironing board as shown in FIG. 5; and FIG. 7 diagrammatically shows an ironing board having identification means and a compartment for containing a wrinkle resistant additive.

FIG. 1 diagrammatically shows an ironing appliance 1 according to the present invention and an article 2 which is intended to be ironed by means of the ironing appliance 1. The ironing appliance 1 comprises an ironing board 10, which is diagrammatically depicted as a box in FIG. 1. An important function of the ironing board 10 is supporting articles 2 to be ironed. Furthermore, the ironing appliance 1 comprises an ironing device 20. In the shown example, the ironing device 20 comprises a steam iron.

The steam iron 20 is a hand-held device, and comprises a heatable soleplate 21 for contacting the articles 2 to be ironed. The steam iron 20 is adapted to supplying steam to the articles 2. In particular, the soleplate 21 of the steam iron 20 is provided with steam holes (not shown). For the purpose of generating steam, the ironing appliance 1 comprises a steam generator 22, which is arranged in the ironing board 10. Within the scope of the present invention, the position of the steam generator 22 in the ironing appliance 1 is not essential. The steam generator 22 may also be accommodated in the steam iron 20, or may be arranged in a separate stand, for example. The steam iron 20 is connected to the steam generator 22 through a steam hose 23.

In general, when a user performs an ironing process, he/she places an article 2 to be ironed on the ironing board 10, picks up the steam iron 20, and moves it over the article 2, wherein the soleplate 21 of the steam iron 20 contacts the article 2. In the process, the soleplate 21 of the steam iron 20 is heated. Also, steam is generated in the steam generator 22, transported through the steam hose 23, and supplied to the article 2 by the steam iron 20. As a result, the article 2 is heated and slightly moistened. Thus, when the article 2 is pressed between the ironing board 10 and the steam iron 20, wrinkles are removed from the article 2.

The way in which the ironing process is effective is dependent of a temperature of the soleplate 21 and characteristics of the supply of steam, among other factors. The ironing appliance 1 is adapted to controlling the temperature of the soleplate 21 and the characteristics of the supply of steam automatically. For this purpose, the ironing appliance 1 comprises a controller 30. In the shown example, the controller 30 is arranged in the ironing board 10.

In order for the controller 30 to be capable of determining appropriate ironing conditions in a given situation, it is important that information regarding the article 2 to be ironed is supplied to the controller 30. In particular, it is important that the controller 30 is supplied with input relating to the fabric type of the article 2, as it is important to adjust the temperature prevailing during the ironing process to this characteristic of the article 2.

For the purpose of transmitting information from the article 2 to the controller 30, an RF ID system is used, wherein an RF ID reader circuit 40 is arranged in the ironing board 10, and wherein an RF ID tag 45 is arranged in the article 2 to be ironed.

An RF ID system is a system known per se, in which radio frequency communication is used to automatically identify and track objects. The RF ID tag 45 attached to the article 2 contains information representing at least one characteristic of the article 2. In this example, the RF ID tag 45 at least contains information regarding the fabric type of the article 2. The RF ID tag 45 includes an electronic circuit, which serves as a transponder, and a tuned antenna-capacitor circuit. During operation of the RF ID system, the RF ID tag 45 acts as a small sophisticated radio transmitter and receiver. For the purpose of powering the RF ID tags 45, the RF ID reader circuit 40 generates a radio frequency field. When the RF ID tag 45 is powered up, it continuously transmits, by damping the incoming radio frequency power field, its information. In FIG. 1, the transmittal of information from the RF ID tag 45 to the RF ID reader circuit 40 is diagrammatically depicted by means of dashed curves.

The RF ID reader circuit 40 has three main functions: energizing, demodulating and decoding. Like the RF ID tag 45, the RF ID reader circuit 40 comprises a tuned antenna-capacitor circuit. In the RF ID reader circuit 40, the information sent by the RF ID tag 45 is demodulated. Furthermore, the information is decoded by a micro-controller that is arranged as an on-board component of the RF ID reader 40. The decoded information is transmitted to the controller 30 by the RF ID reader circuit 40. In FIG. 1, this transmittal of information is diagrammatically indicated by means of an arrow.

On the basis of the information as supplied by the RF ID reader circuit 40, the controller 30 determines associated settings of the steam generator 22 and the steam iron 20, for example the value of a power supply to a heater for heating the soleplate 21 of the steam iron 20. According to a practical possibility, the controller 30 has access to a database or look-up table comprising predetermined combinations of information regarding the article 2 to be ironed and associated settings of the steam generator 22 and the steam iron 20.

When the appropriate settings are found, the controller 30 controls the steam generator 22 and/or the steam iron 20 such as to adopt the determined settings. Furthermore, the controller 30 provides feedback regarding the determined settings to a user of the ironing appliance 1, for example through a display (not shown).

In FIG. 1, the step of providing feedback to a user is diagrammatically indicated by means of a box. An arrow between this box and a box representing the controller 30 serves for indicating the output of the controller 30. Furthermore, in FIG. 1, an output of control parameters from the controller 30 to the steam generator 22 and an output of control parameters from the controller 30 to the steam iron 20 are indicated by means of an arrow as well.

FIG. 2 is a flowchart showing a series of steps which are followed when the ironing appliance 1 as described in the preceding paragraphs is operated.

When the ironing appliance 1 is activated, a system check is performed, and a default setting of the appliance 1 is realized. Subsequently, another check is preformed, for the purpose of finding out whether the user of the ironing appliance 1 has chosen to have a manual override or not. In case a manual override is detected, the ironing appliance 1 is controlled according to input provided by the user. For the purpose of allowing a user to change to iron an article 2 at his/her own preferred ironing settings at any time during operation of the ironing appliance 1, a manual reset mechanism can be provided.

In case there appears to be no manual override, the default setting is maintained as long as there is no input from the RF ID reader circuit 40. When an article 2 having an RF ID tag 45 is put in the vicinity of the RF ID reader circuit 40, input is generated by the RF ID reader circuit 40, which is compared to the default setting first. In case the input appears to match the default setting, this setting is maintained, at least until a new article 2 is put in the vicinity of the RF ID reader circuit 40 and new input is generated. However, in case it appears that the input deviates from the default setting, a look-up table is used to find appropriate ironing settings. Subsequently, the current ironing settings are changed to newly determined ironing settings, and feedback about the latter ironing settings is produced in order to keep the user of the ironing appliance 1 informed.

During operation of the ironing appliance 1, the above-described steps are continually repeated, with the exception of the step of performing a system check and realizing a default setting of the appliance 1. Hence, as long as there is no manual override, the ironing settings are adjusted automatically each time a new article 2 to be ironed is placed on the ironing board 10.

A first preferred embodiment of an ironing board 10 according to the present invention is shown in FIG. 3. In the following, this ironing board will also be referred to as first ironing board 11.

In FIG. 3, the following components of the first ironing board 11 are shown: a steam generator 22, a ventilator 13, a distribution space 14, a perforated plate 15, a heater 16, a cover 17, and RF ID readers 41. When the first ironing board 11 is applied in an ironing process, the articles 2 to be ironed are placed on top of the cover 17 of the ironing board 11. In a practical embodiment, the perforated plate 15 is a metal plate, and the cover 17 is made of thick flannel in order to offer more comfortable ironing.

For the purpose of a reliable detection of the RF ID tag 45 of the articles 2, the RF ID readers 41 are located in the cover 17 of the ironing board 11. In the shown example, the first ironing board 11 comprises two RF ID readers 41, wherein one of the RF ID readers 41 is located at a tip of the ironing board 11, and wherein another of the RF ID readers 41 is located at the centre of the ironing board 11. The locations of the RF ID readers 41 are chosen in order to obtain a quick and reliable identification of the article 2. In practice, when a user displaces an article 2 in order to place it on the ironing board 11, the article 2 will pass the tip of the ironing board 11 first, and the RF ID tag 45 of the article 2 will be detected by the RF ID reader 41 located there. Furthermore, an average user will be inclined to place the article 2 at the centre of the ironing board 11. Hence, when the article 2 is placed on the ironing board 11, its RF ID tag 45 will be continually detected by the RF ID reader 41 located at the centre of the ironing board 11. Although the shown configuration of the RF ID readers 41 in the ironing board 11 is a preferred one, other configuration are possible within the scope of the present invention, wherein the number of RF ID readers 41 does not necessarily need to equal two.

The first ironing board 11 is a so-called active ironing board, as it comprises a steam generator 22, by which it is capable of supplying steam to an article 2 placed on top of the cover 17, and a heater 16, by which it is capable of supplying heat to the article 2. When the steam generator 22 is activated, generated steam is distributed in the distribution space 14, after which the steam moves upward, and eventually leaves the ironing board 11. In the process, the steam passes the perforated plate 15 and the cover 17, which are both permeable to steam. In FIG. 3, a flow of steam from the steam generator 22 to the distribution space 14 is diagrammatically indicated by means of a bent arrow.

The ventilator 13 may be used for different purposes. In the first place, the ventilator 13 may be activated such as to act as vacuum means for realizing an air flow in a downward direction, through the cover 17, the perforated plate 15, and the distribution space 14. In such a case, when an article 2 is placed on the ironing board 11, this article 2 is urged against the cover 17 as a result of the sucking action of the ventilator 13. In this way, the article 2 is securely held in place during the ironing process.

In the second place, the ventilator 13 may be activated such as to act as blowing means for realizing an air flow in an upward direction, through the distribution space 14, the perforated plate 15, and the cover 17. In such a case, when an article 2 is placed on the ironing board 11, this article 2 is inflated as a result of the blowing action of the ventilator 13. In this way, incorrect creases of the article 2 are avoided. In FIG. 3, an air flow in an upward direction is diagrammatically indicated by means of two bent arrows.

When the first ironing board 11 is operated in combination with an ironing device 20 for the purpose of performing an ironing process on an article 2, that article 2 is heated by both the ironing board 11 and the ironing device 20. In the ironing board 11, for the purpose of obtaining an effective heat transfer process between the heater 16 and the article 2, the heater 16 is positioned right underneath the cover 17. Preferably, the heater 16 comprises an electrical heating element, such as a tubular heater or a flat resistive tracks heater.

Preferably, the operation of the steam generator 22, the ventilator 13 and the heater 16 is controlled by a controller 30 (not shown in FIG. 3), which is arranged such as to be capable of receiving and processing information regarding an article 2 to be ironed, wherein such information is obtained with the help of the RF ID readers 41. In this way, in every instant of the ironing process, it is possible for the controller 30 to determine appropriate ironing conditions and associated settings of the various components of the ironing board 11.

In a situation in which a controller 30 is applied, and in which it appears to be necessary to cool down the ironing device 20 as fast as possible in order to avoid damage to the fabric of an article 2 to be ironed, the controller 30 may determine that a heating of the ironing device 20 needs to be disabled, turned off, or strongly reduced, and control this heating accordingly. In order to accelerate such a cooling process of the ironing device 20, the ironing board 11 may be provided with an additional ventilator (not shown), wherein the controller 30 activates this ventilator to blow air or to suck in air, for the purpose of creating an air flow for extracting heat from the ironing device 20.

An ironing board 10 according to the present invention does not necessarily need to be designed like the shown first ironing board 11. For example, the ventilator 13 and/or the heater 16 may be omitted. However, it is preferred that one or more peripheral devices are present in the ironing board 11, as these devices may contribute to an enhanced controllability of the ironing process.

A second preferred embodiment of an ironing board 10 according to the present invention is shown in FIG. 4. In the following, this ironing board will also be referred to as second ironing board 12.

Like the first ironing board 11, the second ironing board 12 is an active ironing board, comprising a steam generator 22, so that the ironing board 12 is capable of treating articles 2 to be ironed with steam. In FIG. 4, a water tank 24 for supplying the steam generator 22 with fresh water during operation of the ironing board 12 is shown.

Furthermore, the second ironing board 12 comprises a number of distribution spaces 14. In FIG. 4, three distribution spaces 14 are shown. A top side of the distribution spaces 14 is closed by a cover 17, which serves for actually contacting the articles 2 to be ironed. At least one ventilator 13 for drying away extra moisture and cooling down the articles 2 by blowing air through the articles 2 is arranged in the second ironing board 12.

For the purpose of ironing an article 2, the second ironing board 12 is used in combination with an ironing device 20, which is moved over the article 2 in a reciprocating manner. In FIG. 4, the reciprocating movement of the ironing device 20 is diagrammatically indicated by means of an arrow having two heads.

During operation of the second ironing board 12 and the ironing device 20, a temperature of the soleplate 21 of the ironing device 20 is kept within a predetermined range of relatively low temperatures, so that the ironing device 20 is mainly used for stretching the articles 2 to be ironed, and there is hardly any risk of the article 2 getting scorched by the soleplate 21. In this situation, a temperature of the ironing process is mainly determined by a temperature of the steam that is supplied by the ironing board 12. In general, it is true that a heating process in which an article 2 to be ironed is heated by means of a supply of steam is a more gentle heating process than a heating process in which the article 2 is heated by means of contact with a hot plate. Preferably, the temperature of the soleplate 21 of the ironing device 20 is kept at a level just above the condensation temperature of steam.

According to the present invention, an RF ID reader circuit 40 (not shown in FIG. 4) is used for identifying at least one characteristic of articles 2 to be ironed with the help of the second ironing board 12, in particular the fabric type of the articles 2, which is taken into account in a process of determining a suitable temperature for the ironing process and an associated suitable temperature of the steam.

When the second ironing board 12 is applied, the RF ID reader circuit 40 is not only used for detecting particulars concerning the type of the article 2 to be ironed. Another function of the RF ID reader circuit 40 is detecting the place of an article 2 that is positioned on top of the cover 17 of the ironing board 12, i.e. detecting which distribution spaces 14 are covered by the article 2, and which are not. The information regarding the place of the article 2 is used for the purpose of determining which distribution spaces 14 should be provided with steam, and which distribution spaces 14 do not need to be used in the process of supplying steam to the article 2. In this way, waste of steam is prevented.

In FIG. 4, a supply of water from the water tank 24 to the steam generator 22 is diagrammatically indicated by means of an arrow. Furthermore, a supply of steam from the steam generator 22 to one of the distribution spaces 14 is indicated by an arrow as well, whereas the possibility of a supply of steam from the steam generator 22 to the other distribution spaces 14 is indicated by means of dotted arrows. The outlet of steam by the second ironing board 12 is diagrammatically depicted in FIG. 4. As only one distribution space 14 is provided with steam, the outlet of steam takes place above only one distribution space 14.

In the second ironing board 12, a controller 30 (not shown) is used, for keeping the temperature of the soleplate 21 of the ironing device 20 at a more or less constant level, for determining characteristics of the supply of steam on the basis of information regarding an article 2 to be ironed, and for determining which of the distribution spaces 14 should be provided with steam on the basis of information regarding the place of the article 2 on the ironing board 12, among other things. The controller 30 is in communication with the RF ID reader circuit 40, as a result of which it is capable of directly receiving information regarding an article 2 to be ironed as detected by this reader circuit 40.

It will be clear to a person skilled in the art that the scope of the present invention is not limited to the examples discussed in the foregoing, but that several amendments and modifications thereof are possible without deviating from the scope of the present invention as defined in the attached claims.

The ironing device 20 which is part of the ironing appliance 1 according to the present invention may comprise a steam iron, but may also comprise another suitable device, such as a steamer or a dry iron. In the latter case, the ironing device 20 is not capable of supplying steam to the articles 2 to be ironed, so that, in case it is required that the articles 2 are treated with steam, it is preferred to apply an active ironing board 10. The same is true for the ironing devices 20 which may be used in combination with the ironing boards 11, 12 according to the present invention.

Within the scope of the present invention, the characteristics to be identified of an article 2 to be ironed are not limited to the shown examples of the fabric type of the article 2 and the place of the article 2 on the ironing board 12. Any characteristic that may constitute an influencing factor in the process of determining appropriate ironing conditions for a given case may be detected. For example, in case the article 2 comprises a garment, it is also possible to identify the type of the garment, such as business shirt, casual shirt, t-shirt, etc., and to determine the ironing settings on the basis of usual requirements regarding the result of the ironing process for the particular type of garment. For example, a business shirt normally needs to be very well pressed, and therefore, in a situation in which the article 2 is identified as a business shirt, the components of the ironing appliance 1 are preferably controlled such that a relatively high temperature and a relatively high steaming rate are realized during the ironing process. Conversely, a casual shirt or a t-shirt normally requires a smart appearance, so that other control parameters may be selected, for example such as to realize a lower steaming rate. An advantage of setting the steaming rate at a lower level in cases in which it is possible to do so, in view of the type of the garment to be ironed, is that a rate at which the ironing appliance 1 runs out of water that is used for the formation of steam is reduced, so that a period during which the ironing appliance 1 may be operated before there is a need for replenishing the water is prolonged.

For the purpose of identifying one or more selected characteristics of the article to be ironed, other identification means than the disclosed RF ID reader circuit 40 and the RF ID readers 41 may be used. It is not essential that the identification means make use of radio frequency communication.

In the disclosed examples, a steam generator 22 is provided for the purpose of generating and supplying steam. That does not alter the fact that any other suitable device may be provided for this purpose in stead of the steam generator 22, for example a boiler.

In the foregoing, an ironing appliance comprising an ironing device 20 such as a steam iron and an ironing board 11 for supporting articles 2 to be ironed is disclosed. In the ironing board 11, RF ID readers 41 are arranged, which serve for identifying the fabric type of the articles 2 to be ironed, which are provided with a tag 45 containing this information. The ironing board 11 is an active ironing board, adapted to supplying steam to the articles 2 to be ironed and having a heater 16 for heating these articles 2. In an ironing process of a given article 2, the characteristics of the supply of steam and the temperature of the heater 16, among other things, are determined on the basis of the information obtained from the tag 45 of the article 2 by the RF ID readers 41. Due to the fact that the readers 41 are arranged in the ironing board 11, the identification process and the process of determining appropriate ironing settings take place in a fast and accurate manner.

FIG. 5 diagrammatically shows a first preferred embodiment of an ironing board having a fragrance compartment 52 and a fan 53 for generating an air flow of fragrance, and FIG. 6 shows a second preferred embodiment of such an ironing board. In the following, the first preferred embodiment as shown in FIG. 5 will be referred to as first fragrance supplying board 50, and the second preferred embodiment as shown in FIG. 6 will be referred to as second fragrance supplying board 51.

The fragrance compartment 52 serves for receiving and containing a fragrance agent 54 for issuing a certain smell, for example a solid fragrance block or a quantity of a fragrance gel. In the first fragrance supplying board 50, the fragrance compartment 52 is an integral part of the board 50. In the shown example, the fragrance compartment 52 is easily accessible, as it comprises a lid 55 which is movable between an opened position and a closed position. Furthermore, the fragrance compartment 52 has an opening 56 for releasing the fragrance.

In the first fragrance supplying board 50, the fragrance compartment 52 is positioned near the fan 53, and the fan 53 is positioned at a lower level than the opening 56 of the compartment 52. During operation of the fan 53, according to the venturi principle, a reduction of the pressure at the opening 56 of the compartment 52 is obtained, as a result of which the fragrance air is sucked out of the compartment 52. In FIG. 5, the release of fragrance air under the influence of the operation of the fan 53 is depicted by means of a horizontal arrow.

The fan 53 is drivable in two opposite directions of rotation. In case the fan 53 is driven in a first direction, it serves as a blowing means, wherein it is capable of creating an air flow in an upward direction, through a top 57 of the first fragrance supplying board 50, which serves for supporting articles to be ironed (not shown in FIG. 5). Hence, in such a case, the air flow of fragrance is used for two main purposes, namely for adding a pleasant smell to the articles to be ironed and for supplying the fragrance to a vicinity of the first fragrance supplying board 50, so that a user of the first fragrance supplying board 50 experiences a pleasant smell. In FIG. 5, the fragrance air flow generated by the fan 53 in case it serves as a blowing means is depicted by three upwardly bent arrows.

In case the fan 53 is driven in a second direction, which is opposite to the first direction, it serves for obtaining a sucking action, wherein the fan 53 is capable of creating an air flow in a downward direction. Hence, in such a case, the air flow of fragrance does not pass the top 57 of the first fragrance supplying board 50, and the air flow is used for just one main purpose, namely for supplying the fragrance to a vicinity of the board 50. In FIG. 5, the fragrance air flow generated by the fan 53 in case it serves for obtaining a sucking action is depicted by means of three downwardly bent arrows.

In FIG. 6, a second fragrance supplying board 51 is shown. A main difference between the first fragrance supplying board 50 and the second fragrance supplying board 51 relates to the position of the fragrance compartment 52 with respect to the fan 53. In the second fragrance supplying board 51, the fragrance compartment 52 is positioned above or below the fan 53, in the path of the air flow which is generated by the fan 53 during its operation. In FIG. 6, both possible positions of the fragrance compartment 52 are depicted.

Similar to the action of the fan 53 in the first fragrance supplying board 50, the fan 53 may be driven to generate an air flow in an upward direction, through the top 57 of the second fragrance supplying board 51, or to generate an air flow in an opposite, downward direction. When the fan 53 is driven to generate an air flow in the upward direction, and the fragrance compartment 52 is positioned above the fan 53, the air flow is directed through the fragrance compartment 52 and the fragrance agent 54 accommodated inside the compartment 52, as a result of which a very effective delivery of fragrance to articles (not shown in FIG. 6) positioned on top of the second fragrance supplying board 51 and a vicinity of the board 51 is obtained. When the fan 53 is driven to generate an air flow in the downward direction, and the fragrance compartment 52 is positioned below the fan 53, the air flow is directed through the fragrance compartment 52 and the fragrance agent 54 accommodated inside the compartment 52, as a result of which a very effective delivery of fragrance to only the vicinity of the board 51 is obtained. In FIG. 6, both the air flow of fragrance in the upward direction and the air flow of fragrance in the downward direction are depicted by means of three vertical arrows.

In both fragrance supplying boards 50, 51, it is possible that two fans are arranged in stead of just one fan 53, wherein the two fans are driveable in mutually opposite directions of rotation, and are arranged in series. In case it is desired to only deliver a fragrance to the vicinity of the fragrance supplying board 50, 51, a fan for generating an air flow in a downward direction is activated, whereas in case it is desired to also deliver a fragrance to articles positioned on top of the fragrance supplying board 50, 51, another fan for generating an air flow in an upward direction is activated.

Preferably, the fragrance compartment 52 is removably arranged with respect to the other components of the fragrance supplying board 50, 51, so that handling of the compartment 52 is facilitated. For example, in cases of refilling or maintenance, it is very convenient for a user if a possibility of removing the compartment 52 from the ironing board 50, 51 exists. The fragrance supplying board 50, 51 may comprise more than one space for receiving the compartment 52. For example, in the case of the second fragrance supplying board 51 as shown in FIG. 6, it is possible have two spaces for receiving the compartment 52, so that a user of the board 50, 51 is allowed to choose whether to position the compartment 52 above or below the fan 53.

Within the scope of the present invention, it is possible that an ironing board 50, 51 is provided, which comprises a compartment for containing another agent than a fragrance agent, in stead of the fragrance compartment 52 as described in the foregoing, or additional to this fragrance compartment 52. For example, a compartment for containing and supplying a wrinkle resistant additive may be arranged in the ironing board 50, 51, wherein suitable means are provided for transporting the additive from the compartment to the articles positioned on the ironing board 50, 51. The number of compartments for receiving and containing an agent for treating the articles and/or influencing vicinity conditions is not limited to one or two.

FIG. 7 diagrammatically shows an ironing board 60 having RF ID readers 41 which are part of a Radio Frequency Identification circuit and a compartment 52 for containing a wrinkle resistant additive. Furthermore, the ironing board 60 comprises a steam generator 22 and a heater 16.

The RF ID readers 41 serve for detecting RF ID tags attached to articles to be ironed with the help of the ironing board 60 and a suitable ironing device such as a steam iron. In particular, the RF ID tags may contain information regarding the type of article present on the ironing board 60. Dependent of the information detected by the RF ID readers 41 arranged in the ironing board 60, the operation of the steam generator 22 and the heater 16 is controlled, such that ironing conditions which are very well adapted to the type of article to be ironed are set. In particular, these ironing conditions are the temperature prevailing during the ironing process and the steaming rate.

In a practical embodiment, for the purpose of controlling the ironing conditions, a controller (not shown in FIG. 7) is provided, which is arranged such as to be capable of receiving and processing information regarding an article to be ironed, wherein such information is obtained with the help of the RF ID readers 41. In this way, in every instant of the ironing process, it is possible for the controller to determine appropriate ironing conditions and associated settings of the various components of the ironing board 60. Advantageously, the controller is also used for controlling a supply of wrinkle resistant additive from the compartment 52 to an article that is present on the ironing board 60.

In the shown example, a sprayer 61 for spraying the wrinkle resistant additive on an article that is present on the ironing board 60 is provided. The sprayer 61 is connected to the compartment 52 containing the wrinkle resistant additive through suitable supplying means 62, which are operable to supply the agent to the sprayer 61. The supplying means 62 and the sprayer 61 are controlled by the controller. For example, in case the RF ID readers 41 detect the presence of a business shirt on the ironing board 60, the controller activates the supplying means 62 and the sprayer 61 to supply a certain quantity of wrinkle resistant additive to the shirt. However, in case the RF ID readers 41 detect the presence of a casual shirt on the ironing board 60, less or no wrinkle resistant additive is needed, and the controller activates the supplying means 62 and the sprayer 61 to supply a smaller quantity of wrinkle resistant additive to the shirt, or the controller does not activate these components at all.

An important advantage of the application of ironing board 60 as shown in FIG. 7 is that a user does not need to provide input for the purpose of obtaining appropriate ironing conditions, due to the fact that an RF ID circuit is arranged for identifying the type of an article that needs to be ironed. Furthermore, there is no need for the user to operate the sprayer 61 for treating the article with wrinkle resistant additive, as the operation of the sprayer 61 is automatically controlled on the basis of input provided by the RF ID circuit.

The invention claimed is:

1. Ironing appliance, comprising:

an ironing device for ironing articles;

an ironing board for supporting the articles; and identification means for identifying at least one characteristic of the articles to be ironed, which means are arranged in the ironing board, wherein the at least one characteristic is indicative of the type of article to be ironed.

2. Ironing appliance according to claim 1, comprising a steam generator, wherein a portion of the ironing board which is intended for contacting and supporting the articles (2) to be ironed is permeable to steam, and wherein conveying means are provided for conveying steam from the steam generator to said portion of the ironing board during operation of the ironing appliance.

3. Ironing appliance according to claim 2, wherein the conveying means comprise at least two separate units.

4. Ironing appliance according to claim 2, comprising means for controlling a temperature of the steam that is supplied to the portion of the ironing board which is intended for contacting and supporting the articles to be ironed during operation of the ironing appliance.

5. Ironing appliance according to claim 1, comprising means for heating a portion of the ironing board which is intended for contacting and supporting the articles to be ironed.

6. Ironing appliance according to claim 1, wherein means for displacing air are arranged in the ironing board, and wherein a portion of the ironing board which is intended for contacting and supporting the articles to be ironed is permeable to air.

7. Ironing appliance according to claim 6, wherein the means for displacing air comprise a ventilator.

8. Ironing appliance according to claim 7, wherein the ventilator comprises two fans arranged in series, wherein one fan is designed for blowing by rotating in a first direction, and wherein another fan is designed for creating suction by rotating in a second direction which is opposite to the first direction.

9. Ironing appliance according to claim 7, wherein the ventilator comprises a single fan which is driveable in two directions of rotation.

10. Ironing appliance according to claim 1, comprising controller means for controlling the operation of the ironing appliance, which controller means are connected to the identification means, and which controller means are adapted to using input provided by the identification means in a process of determining control parameters.

11. Ironing appliance according to claim 1, comprising means for actively cooling down the ironing device.

12. Ironing appliance, comprising:

an ironing device for ironing articles;

an ironing board for supporting the articles; and identification means for identifying at least one characteristic of the articles to be ironed, which means are arranged in the ironing board, wherein the identification means comprise a reader which is capable of generating a radio frequency field for powering tags including an electronic circuit and a tuned antenna-capacitor circuit.

13. Ironing board, suitable for use in an ironing appliance according to claim 1, comprising identification means for identifying at least one characteristic of articles to be ironed.

14. Ironing board according to claim 13, comprising a compartment for containing an agent, wherein the agent is one of an agent for treating articles to be ironed and an agent for supplying a fragrance to at least one of the articles to be ironed and a vicinity of the ironing board, wherein the compartment has at least one opening for releasing the agent.

15. Ironing board according to claim 14, further comprising means for forcing agent to flow out of the ironing board.

16. Ironing board according to claim 14, wherein the compartment is removably arranged with respect to other components of the ironing board.

17. A method for controlling an ironing appliance comprising:

identifying at least one characteristic of an article to be ironed wherein the article is located on a portion of an ironing board intended for contacting and supporting the article, wherein the at least one characteristic is indicative of the type of article to be ironed;

conveying steam from a steam generator to the portion of the ironing board during operation of the ironing appliance; and obtaining required changes of a temperature at which an ironing process takes place on the basis of changes of a temperature of generated steam, while a temperature of an ironing device is kept within a predetermined limited range of temperatures throughout the ironing process.

18. A method for controlling an ironing appliance according to claim 17 further comprising indicating the place of an article to be ironed with respect to units that indicate the position of the article on the ironing board, wherein only the units covered by the article are used for the purpose of conveying steam to the article.

19. Ironing board for supporting articles to be ironed, comprising:

identification means for identifying at least one characteristic of the articles to be ironed, which means are arranged in the ironing board, wherein the at least one characteristic is indicative of the type of article to be ironed; and a compartment for containing an agent, wherein the agent is one of an agent for treating the articles to be ironed and an agent for supplying a fragrance to at least one of the articles to be ironed and a vicinity of the ironing board, wherein the compartment has at least one opening for releasing the agent.

20. Ironing board according to claim 19, further comprising means for forcing agent to flow out of the ironing board.

21. Ironing board according to claim 19, wherein the compartment is removably arranged with respect to other components of the ironing board.

* * * * *